United States Patent [19]

Wardell, Jr.

[11] Patent Number: 4,620,764

[45] Date of Patent: Nov. 4, 1986

[54] PIN BIASING BASE FOR ELECTRON TUBES

[75] Inventor: Myron H. Wardell, Jr., Lititz, Pa.

[73] Assignee: RCA Corporation, Princeton, N.J.

[21] Appl. No.: 753,927

[22] Filed: Jul. 11, 1985

[51] Int. Cl.[4] ..... H01R 33/76

[52] U.S. Cl. ..... 339/145 T; 339/145 R

[58] Field of Search ..... 339/111, 144 R, 144 T, 339/145 R, 145 T; 313/318

[56] References Cited

U.S. PATENT DOCUMENTS

| | | | |
|---|---|---|---|
| 2,113,328 | 4/1938 | Makenny | 250/27.5 |
| 2,421,780 | 6/1947 | Frear | 250/16 |
| 2,470,518 | 5/1949 | Orr | 250/27.5 |
| 2,627,048 | 1/1953 | Lamb | 313/318 |
| 3,569,916 | 3/1971 | Wood | 339/145 R |
| 3,867,670 | 2/1975 | Schor et al. | 317/61.5 |
| 3,979,157 | 9/1976 | DiMattio | 339/145 T |
| 4,040,708 | 8/1977 | Neuber et al. | 339/111 |
| 4,126,371 | 11/1978 | Puhak | 339/144 T |
| 4,127,313 | 11/1978 | Marks | 339/144 T |
| 4,345,812 | 8/1982 | Wardell, Jr. | 339/144 R |

*Primary Examiner*—John McQuade

*Attorney, Agent, or Firm*—E. M. Whitacre; D. H. Irlbeck; L. L. Hallacher

[57] ABSTRACT

The base for an electron tube has pin apertures configured to bias the pins inwardly against the base to help retain the base on the tube and to decrease the possibility of the connector pins being bent outwardly, away from the longitudinal axis of the tube.

3 Claims, 3 Drawing Figures

PIN BIASING BASE FOR ELECTRON TUBES

This invention relates generally to electron tubes and particularly to a pin biasing base for such tubes.

Electron tubes, such as kinescopes for television receivers or other displays, receive the necessary operating voltages through conductive connector pins which protrude from the neck of the tube. Typically, a kinescope includes an exhaust tubulation which is used to exhaust the atmosphere from the tube prior to hermetically sealing the tube. The connector pins are arranged radially about the tubulation at spaced intervals. The voltages are applied to the internal operative components of the tube by electrical connections to the pins. The pins pass through a tube stem which includes a tabulation, and through a base which includes a longitudinal bore for receiving the tubulation. The base is applied against the stem of the kinescope around the tubulation and primarly serves to protect the pins from being bent, or damaged, during shipping and handling of the tube. The base also permits aligned engagement with a corresponding socket through which the operating potentials are coupled to the pins. The connector pins pass through apertures in the base and, because the base must be firmly attached to the tube, at least some of the pins and apertures are provided with interference dimensions. Accordingly, a substantial force is required to pass the pins through the apertures in the base. For this reason, a common problem in the manufacturing of kinescopes and other electron tubes, is that of bent pins which occurs during the application of the base to the tube. The present invention is directed to a tube base for electron tubes, such as kinescopes, which eliminates or substantially reduces the number of bent pins.

SUMMARY

A base for an electron tube having an exhaust tubulation and a plurality of connection pins arranged radially about the tubulation includes an entry portion for receiving the tubulation and the connection pins, and a retention portion for retaining the base on the tube. The entry portion includes a substantially centered bore for receiving the tubulation and a plurality of apertures radially spaced about the base for individually receiving the pins. The apertures are configured to bias the pins inwardly toward the base as the pins pass through the apertures. The retention portion is integral with the entry portion and includes a bore coaxial with, and substantially equal in diameter to the centered bore. The retention portion includes a plurality of longitudinal grooves aligned with the apertures. Each of the grooves has a longitudinal retention surface substantially parallel to the base whereby the pins are biased against the retention surface to help retain the base on the tubes.

DETAILED DESCRIPTION

Figure 1:
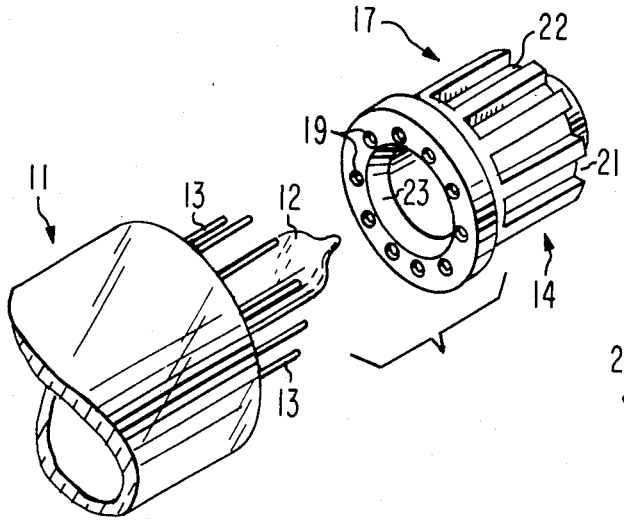
FIG. 1 is an isometric view of a portion of a kinescope neck having a sealed tubulation and a preferred embodiment of the inventive base.
Figure 2:
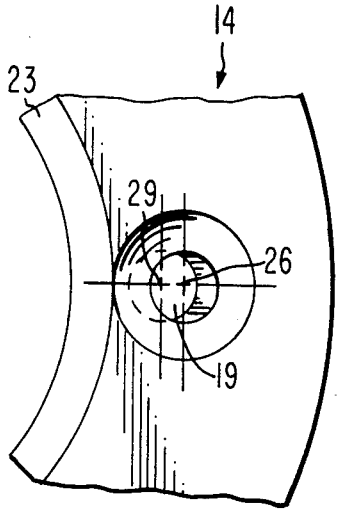
FIG. 2 is an enlarged view of a part of the top of the entry portion of the preferred embodiment of FIG. 1.

In FIG. 1, a neck 11, such as the neck of a kinescope for a television receiver, or any other type of electron tube includes an integral exhaust tubulation 12. The tubulation 12 is used to exhaust the tube, as needed for the operation of the tube, prior to hermetically sealing the tube. A plurality of electrical connector pins 13 is radially spaced about the exhaust tubulation 12. The pins 13 serve to apply the various operating voltages to the various components within the tube.

An insulative base 14, shown in axial alignment with the neck 11 in FIG. 1, includes an entry portion 16, a retention portion 17, and a centered longitudinal bore 18 extending through both the entry portion 16 and the retention portion 17. A plurality of apertures 19 is radially spaced about the center bore 18. The apertures 19 are spaced and dimensioned to engage the connector pins 13. In order to ensure that the proper pins receive the proper voltages, the pins 13 and apertures 19 typically are spaced in a pattern such that there is only one relative position in which the pins and apertures are aligned and the base 14, therefore, can be applied to the neck 11 in only the proper orientation. The tubulation 12 extends into the bore 18 and the tubulation 12, thus, is protected from being broken off by the base 14.

The retention portion 17 of the base 14 includes a plurality of longitudinal grooves 21 extending from the entry portion 16 to the distal end of the base. The bottom surfaces 22 of the grooves 21 serve as longitudinal retention surfaces against which the pins 13 are biased to prevent damage to the pins and to help hold the base 14 on the neck 11. Also, if desired, the base 14 can be affixed to the neck 11 by the use of an appropriate adhesive.

Figure 3:
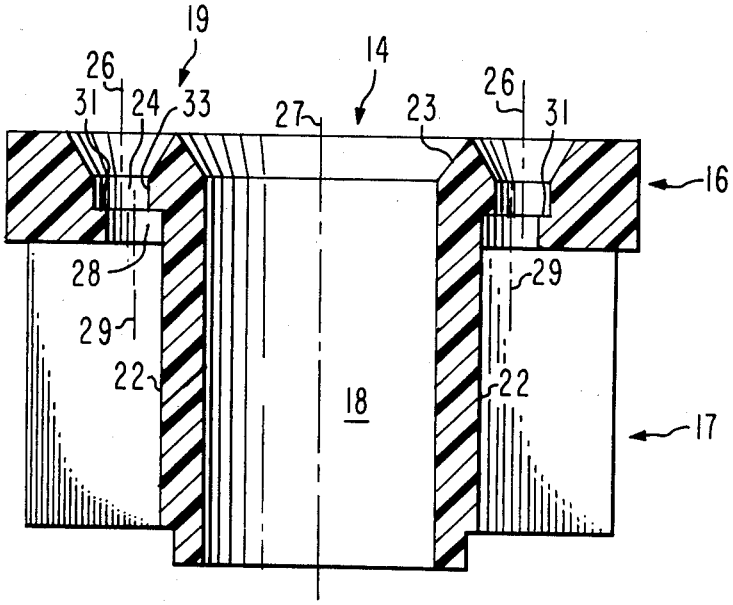
FIG. 3 is a cross section of the preferred embodiment of FIG. 1.

In FIG. 3, the entry of the bore 18 is provided with a beveled surface 23 to assist the entry of the exhaust tubulation into the center bore 18. The entries of the apertures 19 also are beveled to assist the entry of the pins 13 into the apertures 19. The apertures 19 include a first section 24 the centers of which are a preselected distance from the center line 27 of the center bore 18, as represented by the center lines 26. The apertures 19 also include a second section 28, the center lines 29 of which are a second, and lesser, preselected distance from the center line 27 of the bore 18. The diameters of the first section 24 can be slightly larger than the diameters of the pins 13 to assist the entry of the pins into the apertures. The offset of the center lines 26 and 29 of the first and second sections 24 and 28, respectively, of the apertures 19 form a small shoulder 31. The diameters of the sections 28 are substantially equal to the diameter of the pins 13 and thus are smaller than the section 24 diameter. The opening extending across the apertures in the plane of the shoulder 31 therefore is less than the diameter of the pins 13. Thus, as the pins 13 are inserted into the apertures 19 and begin to enter section 28 the shoulder 31 deforms and serves to preferentially bend, or bias, the pins inwardly toward the center line 27 of the bore 18 so that the pins 13 snugly engage the longitudinal retention surfaces 22 of the base 14. The pins typically are rounded on the end and, accordingly, the shoulders 31 merely preferentially deform the pins, instead of preventing the pins from entering the apertures 19. Accordingly, the pins 13 are firmly biased against the retention surfaces 22 to help retain the base 14 on the neck 11. Also, the pins 13 are prevented from being bent outwardly, away from the center line 27 during the insertion of the pins into the apertures 19. During manual assembly of the base 14 onto a neck 11, it is possible for the longitudinal axis 18 of the base to be tilted with respect to the longitudinal axis of the neck 11. The offset between the aperture sections 24 and 28 still serves to bias the pins 13 inwardly toward the longitudinal axis 27 and thereby prevents the pins from being bent away from the longitudinal axis.

The appropriate operating voltages are applied to the pins 13 by the use of a female type connector, or socket, which is configured to mate with the base 14. The mating socket also includes electrical contacts which are placed into electrical contact with the connector pins 13. These contacts are arranged in the same pattern as the pins 13 to assure that each internal component of the tube receives the proper operating potential. The two sections 24 and 28 can be formed by drilling the base 14 from opposite ends; but preferably, the base 14 is formed by injection molding to include the offset aperture sections.

What is claimed is:

1. A base for an electron tube having an exhaust tubulation and a plurality of connection pins arranged radially about said tubulation, said base comprising:

an entry portion for receiving said tubulation and said connection pins, and a retention portion for retaining said base on said tube;

said entry portion including a center bore for receiving said tubulation, a plurality of apertures radially spaced about said bore for individually receiving said pins, said apertures being configured to bias said pins inwardly toward said bore as said pins pass through said apertures;

said retention portion being integral with said entry portion, and having a bore coaxial with said center bore and substantially equal in diameter to said center bore, said retention portion including a plurality of longitudinal grooves aligned with said apertures, each of said grooves having a longitudinal retention surface substantially parallel to said bore whereby said pins are biased against said retention surface to help retain said base on said tube;

at least one of said apertures including a first section having a first axis substantially parallel to said center bore, and a second section having a second axis substantially parallel to said center bore, said second axis being closer to said center bore then said first axis to form a shoulder, said first and second sections being in communication whereby said pins pass through said sections and are biased by said shoulder against said retention surface.

2. The base of claim 1 wherein said first and second sections are substantially circular and said second section has a diameter substantially equal to the diameter of said pins.

3. The base of claim 1 wherein the entry of said second section, in the plane of said shoulder, has a diameter smaller than the diameter of said pins.

* * * * *